United States Patent [19]

Buckner

[11] 4,360,053

[45] Nov. 23, 1982

[54] GLASS FIREPLACE SCREEN

[75] Inventor: Carrol E. Buckner, Weaverville, N.C.

[73] Assignee: Buck Stove Corporation, Asheville, N.C.

[21] Appl. No.: 845,705

[22] Filed: Oct. 26, 1977

[51] Int. Cl.[3] ..... E06B 9/00

[52] U.S. Cl. ..... 160/352; 160/88

[58] Field of Search ..... 160/88, 179, 183, 352, 160/92; 126/140, 202; 52/202, 203, 397–400

[56] References Cited

U.S. PATENT DOCUMENTS

| | | | |
|---|---|---|---|
| 2,093,314 | 9/1937 | MacDonald | 160/183 |
| 2,719,341 | 10/1955 | Clerk | 52/398 |
| 3,053,566 | 9/1962 | Allen | 160/179 |
| 3,227,206 | 1/1966 | Rocco et al. | 160/88 |
| 4,010,730 | 3/1977 | Mitchell | 126/140 |
| 4,048,979 | 9/1977 | LaVasseur | 126/140 |

*Primary Examiner*—Peter M. Caun

*Attorney, Agent, or Firm*—Leitner, Palan, Martin & Bernstein

[57] ABSTRACT

A fireplace screen having a transparent, air impermeable plate forming the front face held by a frame to two air permeable side faces. The top frame element is removably secured to allow removal of the plate.

11 Claims, 3 Drawing Figures

GLASS FIREPLACE SCREEN

FIELD OF THE INVENTION

The present invention relates generally to fireplace screen and more specifically to a glass fireplace screen.

DESCRIPTION OF THE PRIOR ART

Fireplace screens come in many shapes as well as many materials. Fireplace screens of the prior art have generally included wire or open mesh so as to permit air flow into the fireplace while limiting the egress of the material from the fireplace, for example, sparks, wood, and other objects. Many physical designs have been used to provide stability and other desired functions.

With the increase of fuel cost, there has been generally great interest in providing a closure for a fireplace so as to prevent the heat from the home to enter the fireplace and escape up the flue. Similarly, it has been found to be desirable to limit the air flow into the fireplace causing the fire to burn more slowly to thereby increase the heat the burning material can produce. To achieve these ends, the prior art has completely enclosured the fireplace opening with a frame having a pair of doors and a vent. These doors are generally glass wherein the vent regulates the flow of air into the fireplace from the room while the doors are generally closed during the use. These glass doors enclosures are relatively expensive and require permanent installation to the fireplace itself.

Thus there exists a need for an inexpensive fireplace closure which provides maximum viewing of the fire for artistic purposes while minimizing the air flow into the fireplace.

SUMMARY OF THE INVENTION

The present invention is a fireplace screen which is movable placed in front of a fireplace having a front face which is transparent and air impermeable while having two side faces which are air permeable. The front face provides maximum viewing of the fire while limiting the air flow into the fireplace to the two side faces. The front frame includes two horizontal and two vertical L-shaped members. The side faces include a back vertical and a bottom horizontal frame member connected together and at their opposite ends to the top and bottom front frame horizontal members respectively. A back frame member extends between the two side faces to complete the frame of a bottom face. The top frame member includes two pieces, the first of which is permenantly affixed to the top of the side face horizontal members and the second of which is removably secured. The removable secured top member includes a plurality of tabs extending therefrom and fasteners removably attaching the tabs to the permenently secured top frame member. The removable top frame member allows access to the transparent plate such that it may be removed from the frame. Two additional vertical members adjacent the vertical front frame members securely hold the glass in place. The two side faces and the bottom faces includes either a fine open mesh or a structural open mesh or a combination thereof. The front plate may be glass, plastic or other heat tempered material.

OBJECTS OF THE INVENTION

An object of the present invention is to provide an inexpensive closure for a fireplace.

Another object of the invention is to provide a fireplace screen having a front face which allows viewing of the fire while limiting the air flow to the side faces.

A further object of the invention is to provide a glass fireplace screen which allows a transparent front face to be easily removed.

Still another object of the invention is to provide an inexpensive glass fireplace screen.

An even further object of the invention is to provide a movable fireplace closure.

Other objects, advantages and novel features of the invention will become apparent from the detailed description of the invention when considered in conjection with the accompanying drawings.

DESCRIPTION OF THE PREFERRED EMBODIMENTS

Figure 1:
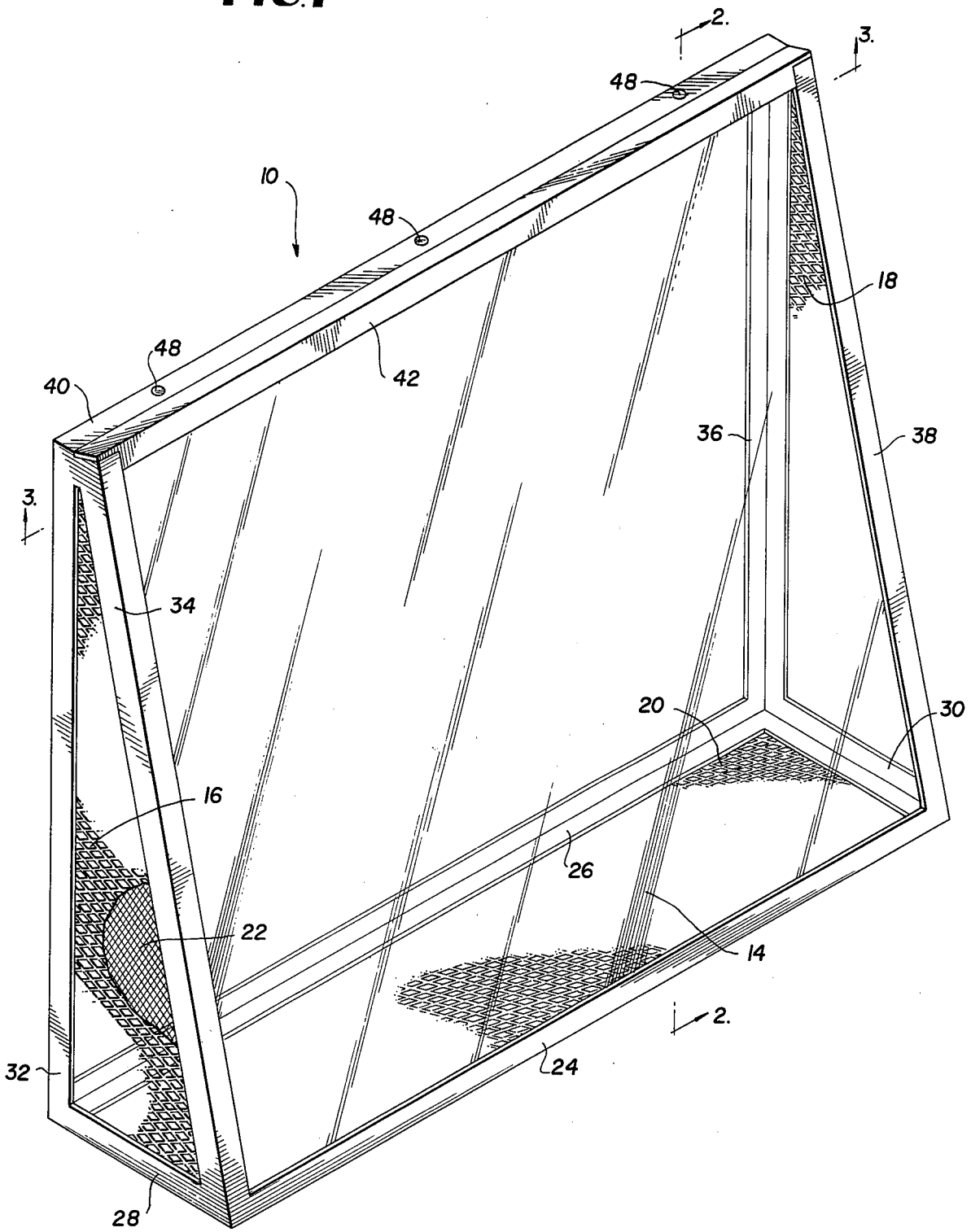
FIG. 1 is a perspective view of a fireplace screen incorporating the concepts of the present invention.

FIG. 1, which illustrates a preferred embodiment of the fireplace screen of the present invention, shows a fireplace screen 10 having a front face 14, side faces 16 and 18 and bottom face 20. The front face 14 comprises an air impermeable transparent plate or panel which is capable of withstanding the temperature of the fireplace. This material may be, for example heat tempered glass or plastic. Side faces 16 and 18 and bottom face 20 generally include an open mesh or an air permeable material. This material may include expanded metal which adds to the structural strength of the frame and aids in the support of the weight of the glass panel 14 or may include an open mesh of firescreen material. As illustrated on side face 16, the large open mesh is combined with the fireplace screen 22. The choice of the specific materials for the front face 14 and the side face 16, 18 and bottom face 20 is a matter of design depending upon a specific structural requirement. The important feature is that the front face be air impermeable while being transparent to allow viewing while preventing air moving through the front face and that the side faces be air permeable allowing air to flow into the fireplace to allow burning of the materials therein.

The bottom face 20 includes frame member 24 and 26 connected between frame members 28 and 30. Side face 16 includes frame members 32 and 34 and side face 18 includes frame members 36 and 38. The top frame includes frame elements 40 and 42. Frame elements 24, 34, 38, 42 form the frame for the front face. A pair of additional frame elements 44 are secured to frame elements 34 and 38 parallel to the front face 14 so as to hold the transparent panel 14 between frame elements 44 and frame elements 34, 38 with the bottom of panel 14 resting on frame element 24.

The preferred construction of the frame includes the use of L-shaped elements except for the panel elements 44. All the frame elements are welded together except element 42. Frame element 42 includes a plurality of tabs 46 welded thereto which extend across the other top frame element 40. A plurality of fasteners 48 extend through openings in tab 46 and are received in openings in top frame 40 so that frame element 42 is movably secured to the top frame element 40. The ends of movable top frame element 42 includes a shoulder so as to be received by the top of frame elements 34 and 38 and to rest thereon.

Figure 2:
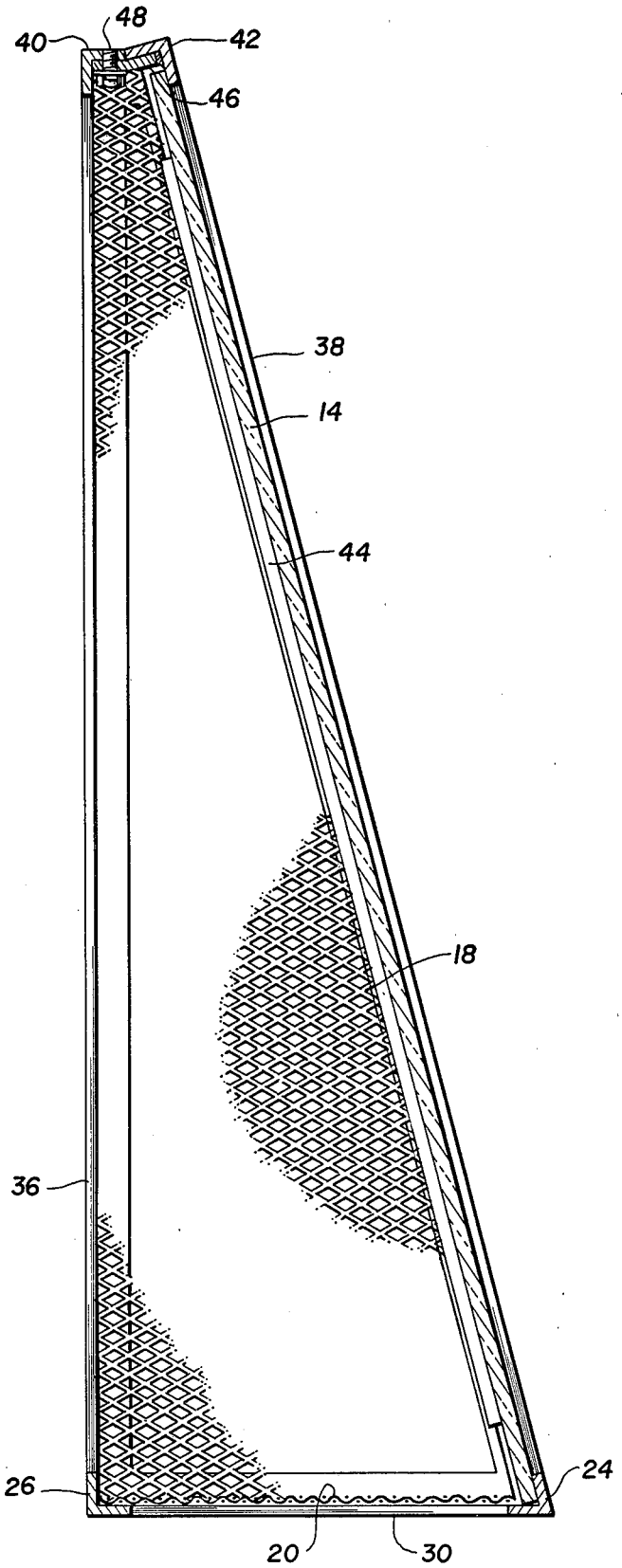
FIG. 2 is a side cross-sectional view taken along lines 2—2 of FIG. 1.
Figure 3:
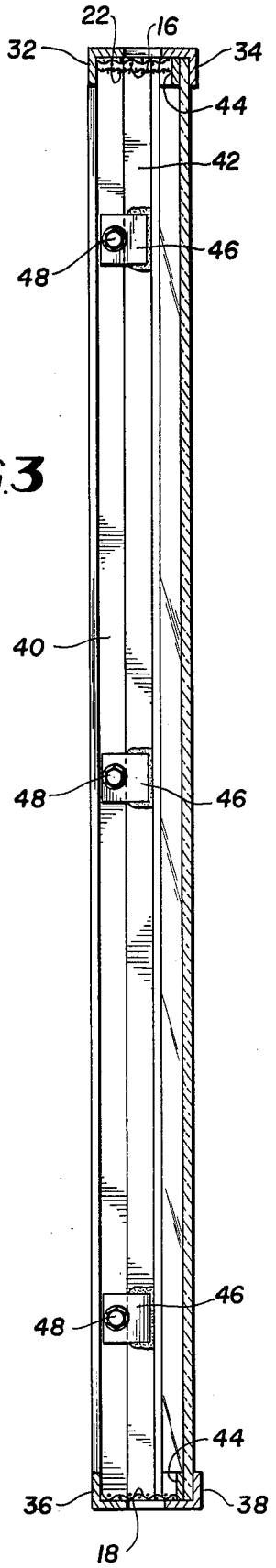
FIG. 3 is a top cross-sectional view taken along lines 3—3 of FIG. 1.

As can be seen by FIG. 2 the transparent front panel 14 rests on the parallel frame elements 44 and the bottom resting on element 24. By securing the tabs 46 to the removable frame elements 42, the fasteners 48 lie behind the front panel 14 and thus are out of view of the user and are readily accessible.

Although the top frame members includes a removable portion 42, the fireplace screen may also be built with the bottom member 24 being removable or the side frame members 34, 30 may be removable. These alternate embodiments are not desired since the frame elements 24, 34 and 38 carry the load of the glass thus if they are removable it could possibly diminish the strength of the frame. Similarly, the rear frame elements 26 and bottom face 20 may be deleted. It is desirable to have a bottom face 20 to catch falling debris, for example, logs rolling out of the fireplace as well as adding to the structural stability to the side faces. Although the side faces have been illustrated as including open mesh, be it fireplace screening or expanded metal, a shutter or other controled surface may be used. The desired use of the open mesh reduces the number of moving parts and greatly reduces the costs of manufacture of the preferred embodiment.

From the preceding description of the preferred embodiments, it is evident that the objects of the invention are obtained. Although the invention has been described and illustrated in detail, it is to be clearly understood that the same is by way of illustration and example only and is not to be taken by way of limitation. The fireplace screen of the present invention may also be considered a movable closure which provides an economically feasible alternative to the permenantly fixed fireplace enclosures. The spirit and scope of this invention is to be limited only by the terms of the appended claims.

What is claimed:

1. A fireplace screen comprising:

a front face having a rectangular frame, an air-impermeable transparent panel and means for mounting said panel to said rectangular frame, a portion of said rectangular frame being removably secured thereto for permitting removal of said panel, said removable portion comprising a fixed frame member and a removable frame member, said removable frame member having connected thereto at least two tab elements, each of said tab elements having a planar surface extending across said fixed frame member, each of said planar surfaces having openings to receive fastening means therethrough, said fastening means further being removably received in openings in said fixed frame member and said openings in said planar surfaces and said fixed frame member being aligned to receive said fastening means in a direction substantially normal to the planar surfaces of said tab elements;

a pair of side faces each having a triangular frame rigidly connected to opposed edges of said rectangular front frame so as to incline said front face relative to the horizontal, and open mesh secured to said triangular frame; and a bottom frame member rigidly interconnecting the rear bottom of said triangular side frames.

2. The fireplace screen according to claim 1 including a bottom face having a rectangular frame including said bottom frame member and open mesh secured to said rectangular bottom frame.

3. The fireplace screen according to claim 2 wherein said open mesh in said side faces is a fine screen mesh and said open mesh in said bottom face is an expanded metal mesh.

4. The fireplace screen according to claim 1 wherein said transparent panel is a glass panel.

5. The fireplace screen according to claim 1 wherein said open mesh of said side face includes an expanded metal mesh and a fine screen mesh.

6. The fireplace screen according to claim 1 wherein said transparent panel is a plastic.

7. The fireplace screen according to claim 1 wherein said removable portion is the top of said rectangular front frame.

8. The fireplace screen according to claim 1 wherein said removable portion is a side of said rectangular front frame.

9. The fireplace screen according to claim 1 wherein adjacent elements of the front frame and the side frames are unitary.

10. The fireplace screen according to claim 1 wherein said side faces extend substantially perpendicular from said front face.

11. The fireplace screen according to claim 1 wherein said frame includes four elements having L-shaped cross section and two vertical elements spaced adjacent a respective vertical L-shaped element, said panel rests between said vertical elements and said four L-shaped elements.

* * * * *